United States Patent [19]

Boroski et al.

[11] 3,999,412

[45] Dec. 28, 1976

[54] RATIONING CIGARETTE DISPENSER

[75] Inventors: Henrietta M. Boroski; Stanley T. Boroski, both of Seymour, Conn.

[73] Assignee: The Raymond Lee Organization, Inc., New York, N.Y. ; a part interest

[22] Filed: Apr. 12, 1976

[21] Appl. No.: 675,726

[52] U.S. Cl. ..... 70/269

[51] Int. Cl.[2] ..... E05B 43/00

[58] Field of Search ..... 70/269, 267, 268, 270, 70/271, 272, 273, 274, 266, 63

[56] References Cited

UNITED STATES PATENTS

| | | | |
|---|---|---|---|
| 2,613,527 | 10/1952 | Harris | 70/273 |
| 2,618,956 | 11/1952 | Hanna | 70/273 |
| 2,812,851 | 11/1957 | Kinnebrew | 70/273 X |
| 3,017,763 | 1/1962 | Weil | 70/269 |
| 3,206,957 | 9/1965 | Reitzes | 70/272 |

*Primary Examiner*—Robert L. Wolfe
*Attorney, Agent, or Firm*—Howard I. Podell

[57] ABSTRACT

A cigarette case, the cover of which is fitted with a latch that is opened by clockwork mechanics in only after a fixed interval of time. The cover of the holder is fitted with a plurality of angle members which lift one cigarette out of the case when the cover is opened and prevent access to the remainder of cigarettes in the case in the open position of the holder.

4 Claims, 3 Drawing Figures

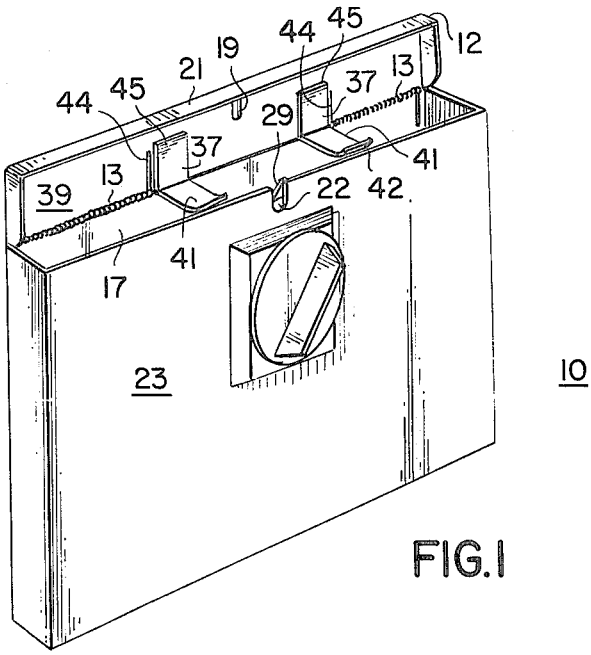
FIG.1
FIG.2
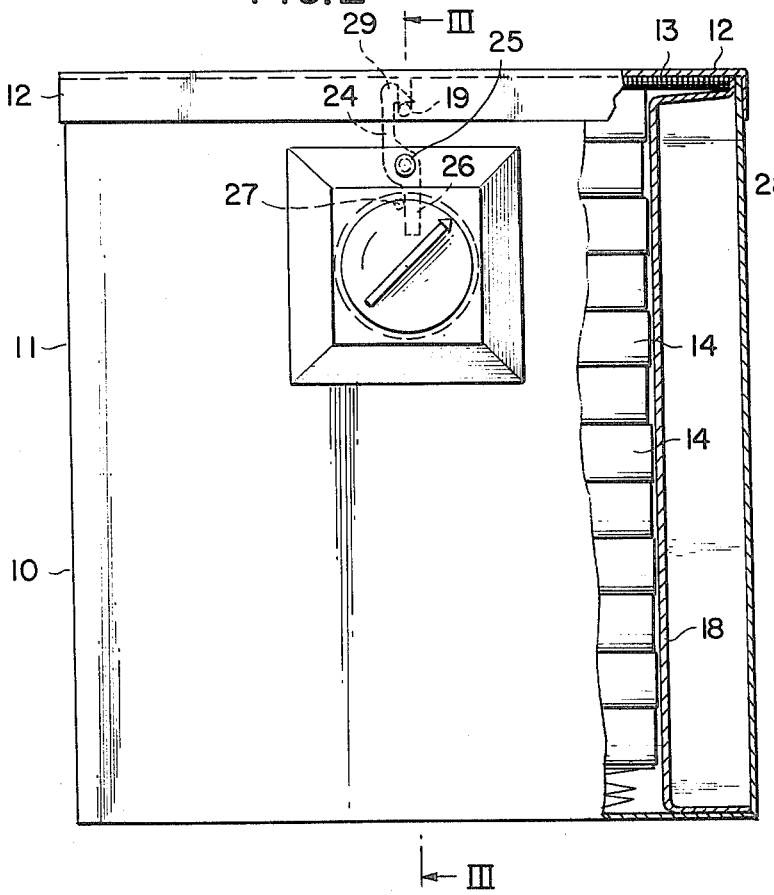
FIG.3
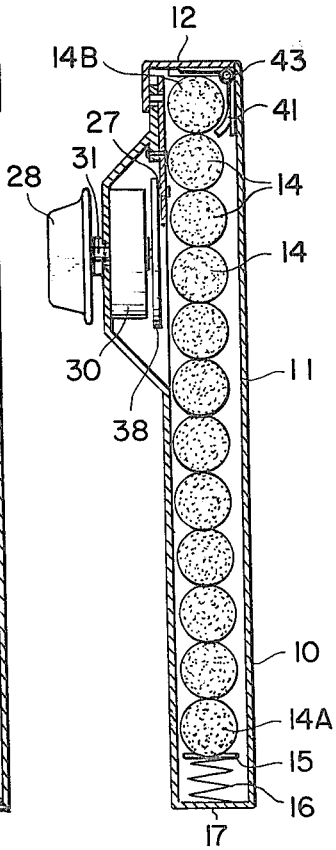

RATIONING CIGARETTE DISPENSER

SUMMARY OF THE INVENTION

Our invention is a cigarette case, the cover of which is fitted with a latch that is opened by clockwork mechanics in only after a fixed interval of time. The cover of the holder is fitted with a plurality of angle members which lift one cigarette out of the case when the cover is opened and prevent access to the remainder of cigarettes in the case in the open position of the holder.

By means of our invention, the user may ration his use of cigarettes to limit the quantity he smokes.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention;

FIG. 2 is a elevation view of the invention; and

FIG. 3 is a sectional view of the invention, taken along line III—III of FIG. 2.

DESCRIPTION OF THE PREFERRED EMBODIMENT

Turning now descriptively to the drawings, in which similar reference characters denote similar elements throughout the several views, FIGS. 1–3 illustrate the cigarette case 10 which is formed of a rectangular box section 11 to which a cover 12 is hingeably mounted, with a torsion spring 13 mounted about the hinge joint to bias the cover 12 in the open position. The box section 11 is shaped to carry a single row of plurality of cigarettes 14 in parallel orientation with the innermost cigarette 14A resting on a platform 15 biased against the bottom panel 17 of the box section 11 by a compression spring 16, and with the outermost cigarette 14B held by the bias of spring 16 against the inner face of cover 12, when the cover 12 is in the closed position as shown in FIGS. 2–3.

The mouth opening 17 of box section 11 is of the width and length of a king size cigarette and a spacer 18 may be installed in box section 11 for use with shorter size cigarettes 14.

A detent 19 is fixed to an inside face of the end flange 21 of the cover to engage a notch 22 in the front panel 23 of box section 11, with a spring biased latch 24 pivotably mounted to the inner face of panel 23 that is biased to latch detent 19 in the closed position of cover 12. Latch 24 is in the form of a lever pivotably mounted about a torsion spring 25 with a tongued flange 29 on a first end of the lever that engages detent 19 and an extension arm 26 on the opposed second end of the lever. Extension arm 26 may be rotated by a detent 27 projecting from the inner face of a rotatable timer disc 38 to rotate latch 24 so as to disengage latch tongue 29 from engagement with cover detent 19 to permit cover 12 to spring open.

Timer knob 28 is fixed to a shaft 31 of a spring wound timer mechanism 30 mounted to panel 23 with manual rotation of timer knob 28 and shaft 31 serving to wind the timer mechanism causing timer disc 38 to rotate in one direction, with detent 27 of timer disc 38 at the completion of each rotation of disc 38 serving to disengage latch 24. If desired, a manual operated latch (not shown) may be also fixed to cover 12 to prevent the cover 12 from automatically opening when latch 24 releases detent 19.

A pair of angle members 37, each formed of a base leg 45 bent at right angles to an arm section 41, are rotatably hinged to the under face 39 of cover 12. The projecting arm section 41 is formed with a curved lip 42 that normally rests between the outermost cigarette 14B and the adjacent cigarette 14 in the case, when the cover 12 is in the closed position.

Opening of cover 12 serves to rotate arm section 14 about outermost cigarette 14B to elevate said cigarette 14 out of the box section, while blocking box opening 17 to prevent removal of any additional cigarettes 14 in the box. If desired, angles 37 may be shaped to extend across a substantial width of the cover 12.

Each angle member 37 rotates about hinge pin 43 to which cover 12 is hinged, with an end 44 of torsion spring 13 resting against the base leg 45 of each angle member 37 to bias base leg 45 against the underface 39 of cover 12. Cigarettes may be individually added into box section 11 by pressing them individually against legs 41 of the angle members 37 and rotating the angle members 37 away from the opened cover. The angle members are spaced from each other to enable the user to manually push a cigarette, being installed, in the box section to clear engagement with the arms 41 as angle members 37 are permitted to freely rotate back against cover 12.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what we claim as new and desire to secure by Letters Patent of the United States is:

1. A cigarette container, the cover of which is latched by a clockwork mechanism to ration the release of individual cigarettes from the container, comprising
   - a box section of a size to retain a plurality of cigarettes in parallel configuration in a single row, said box section formed with a mouth opening of the size to fit about a cigarette,
   - said box section fitted with a platform mounted in a parallel plane to the mouth opening of the box and biased by compression springs towards said mouth opening,
   - a cover hingeably mounted about said mouth opening,
   - a clockwork mechanism mounted to the container fitted with means to latch said cover during the period of a timed interval, together with
   - means to limit the release of only one cigarette from the box section when the cover is opened from the closed position of the cover.

2. The combination as recited in claim 1 in which an arm member is rotatably linked to the underface of the cover and shaped to rest in the closed position of the cover, between the position occupied by a first cigarette adjacent to the cover and a second cigarette adjacent to the first cigarette, said arm member linked to rotate towards the mouth opening of the box section when the cover is opened so as to elevate the said first cigarette out of the box, while blocking the removal of said second cigarette.

3. The combination as recited in claim 2 in which the arm member is spring biased to lie in a plane generally parallel to the mouth opening of the box in the open position of the cover.

4. The combination as recited in claim 3 in which the arm member is mounted so as to be freely rotatable into the box and away from the mouth opening of the box, in the open position of the cover to permit filling of the box with cigarettes.

* * * * *